United States Patent [19]

Dufour

[11] 3,986,558

[45] Oct. 19, 1976

[54] PETROLEUM EXTRACTION METHOD AND ASSEMBLY

[76] Inventor: Francois Dufour, 824 - 4th Ave., Verdun, Quebec, Canada

[22] Filed: Jan. 21, 1975

[21] Appl. No.: 542,658

[30] Foreign Application Priority Data

July 11, 1974 Canada ..... 204566

[52] U.S. Cl. ..... 166/303; 166/205; 166/222; 166/236

[51] Int. Cl.[2] ..... E21B 43/20; E21B 43/24

[58] Field of Search ..... 166/56, 61, 157, 158, 166/168, 205, 236, 303, 222, 223

[56] References Cited

UNITED STATES PATENTS

| | | | |
|---|---|---|---|
| 546,267 | 9/1895 | Braden | 166/168 |
| 1,648,925 | 11/1927 | White | 166/236 |
| 1,656,550 | 1/1928 | White et al. | 166/56 |
| 2,179,020 | 11/1939 | Ranney | 166/205 |
| 2,375,865 | 5/1945 | Nebolsine | 166/56 |
| 2,754,098 | 7/1956 | Heinze | 166/303 |
| 2,871,948 | 2/1959 | Normand | 166/303 |
| 2,929,451 | 3/1960 | Hurlstone et al. | 166/303 |
| 3,140,744 | 7/1964 | Bailly | 166/61 |
| 3,242,989 | 3/1966 | Schlicht et al. | 166/61 |

*Primary Examiner*—Ernest R. Purser
*Assistant Examiner*—Jack E. Ebel

[57] ABSTRACT

A method and assembly adapted to extract petroleum from a bore hole or well and particularly using steam to release the petroleum from the surrounding underground. These method and assembly include the release of steam at the bottom of a tube section and extraction of petroleum above the steam outlet to provide simple and efficient assembly and method, which allow for simultaneous feeding of steam and pumping out of petroleum. The assembly includes coaxial tube sections wherein steam pipes are placed in the annular space between the tube sections to outwardly feed steam at the bottom of the latter while defining a central passage for pumping the petroleum therefrom.

4 Claims, 4 Drawing Figures

PETROLEUM EXTRACTION METHOD AND ASSEMBLY

This invention relates to the extraction of petroleum from the underground and, more particularly, to a method and an assembly of the type particularly using steam to facilitate the release of petroleum from the underground surrounding a bore hole or well.

So far, there have been proposed numerous assemblies, systems and methods using steam to release petroleum from the underground surrounding a bore hole. In the known prior art, such assemblies and methods use a pair of coaxial tubes defining an annular passage and a central passage; the steam is directly fed in one passage and the oil is pumped out either from the same or from the other passage.

It is a general object of the present invention to provide novel and improved assembly and method of the above type for the extraction of petroleum from a bore hole or well.

It is a more specific object of the present invention to provide more simple and efficient assembly and method of the above type for the extraction of petroleum wherein steam is released at the bottom of a tube section and the petroleum is extracted above the steam outlet, and wherein pumping out of the petroleum is done by a simple bucket displaceable up and down in a central tubular passage without having to interrupt the feeding of steam to the surrounding underground.

The above and other objects and advantages of the present invention will be better understood in the light of the following detailed description of a preferred embodiment thereof which is illustrated, by way of example, in the accompanying drawing, wherein.

Figure 1:
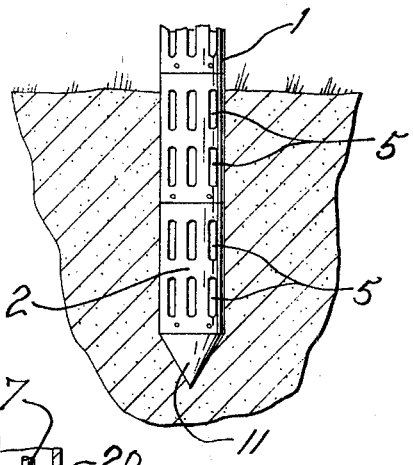
FIG. 1 is a side elevation view of a string of bore hole units according to the invention in operative position in a well or bore hole.
Figure 2:
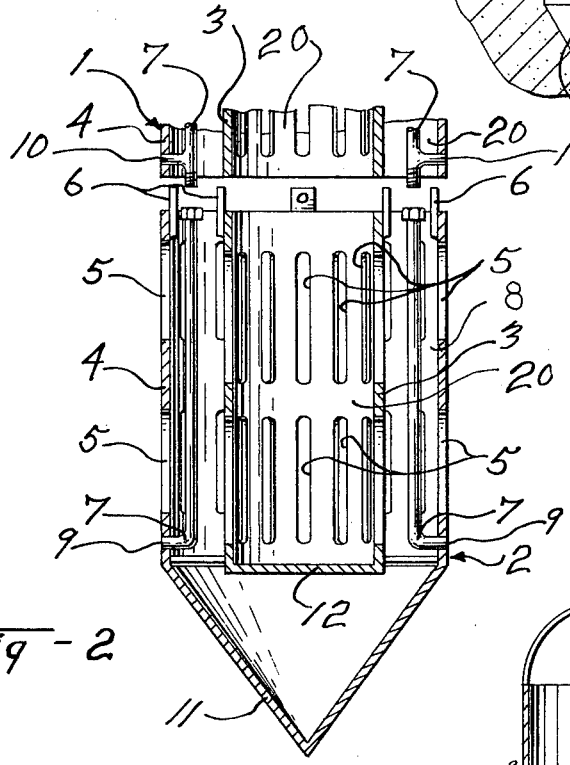
FIG. 2 is a cross-sectional view of a pair of interconnected bore hole units taken along the axis thereof.

The illustrated invention includes a string of bore hole units 1 and a bottom one 2. Each bore hole unit 1 or 2 includes an inner and an outer tube sections 3 and 4 coaxially secured relative to each other and each having a plurality of apertures or slots 5 therethrough. The tube sections 3 and 4 are interconnected end to end by any suitable means, such as protruding ears 6.

A plurality of pipes 7 are secured into the annular space 8 defined between the corresponding tube sections 3 and 4 and are arranged in spaced parallel relationship along the circumference of this annular space. The upper end of each pipe 7 and the lower end of each pipe of the bore hole units 1 are adapted to be tightly interconnected for the passage of steam therein. The lower end of each pipe 7 of the bottom bore hole unit 2 is formed with an elbow 9, or the like, to form an outlet to outwardly feed steam throught the corresponding tube section 4. Similarly, the lower end of each pipe 7 of the overlying bore hole units 1 is formed with a tee 10, or the like, to outwardly feed steam through the corresponding outer tube section 4.

The lower end of the bottom bore hole unit 2 is formed with a conical end 11 closing the corresponding tube section 4 and a flat end 12 closing the corresponding tube section 3. Thus, the outer tube section 4 of the bottom bore hole unit 2 forms a downwardly projecting point 11 to facilitate insertion of the string of bore hole units 1 and 2 into the bore formed in the ground. Alternately, unit 2 with its pointed end can be used to produce the bore in the ground such that the well is formed by successively driving the units 2 and 1.

Figure 3:
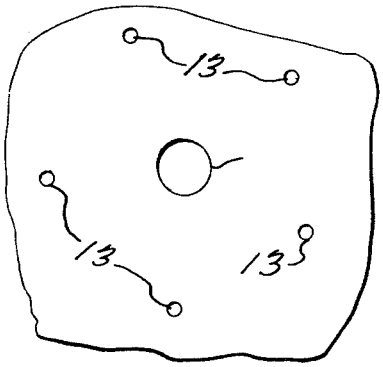
FIG. 3 is a schematic plan view illustrating a method and assembly according to the present invention.

As shown in FIG. 3 and to favor release of the petroleum from the underground, the string of bore hole units 1 and 2 may be surrounded by a plurality of pipes 13 driven into the ground around the latter to supply steam additionally to the steam fed by the pipes 7 of these units.

Figure 4:
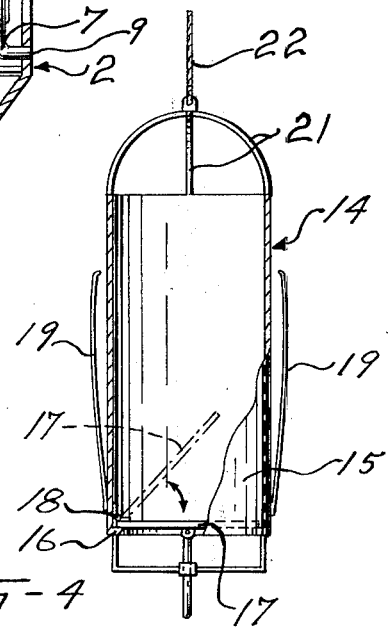
FIG. 4 is a side view of a bucket according to another aspect of the present invention.

A bucket 14 is illustrated in FIG. 4 and is adapted to be used in co-operation with the string of bore hole units of the preceding figures. The bucket 14 includes a cylindrical wall 15 having open ends and defining an internal annular shoulder 16 at the bottom end. A circular plate 17 is hinged at 18 above the annular internal shoulder 16 and co-operates with the latter to form a check valve allowing the entry of petroleum into the bucket 14 upon lowering or immersion of the latter therein. Resilient strips or spring blades 19 are secured around the cylindrical wall 15 and are outwardly bent to form resilient guides for the up-and-down displacement of the bucket 14 into the central passage 20 formed internally of the overlying tube sections 3. A multi-legged hooking bracket 21 is secured to the top of the cylindrical wall 15 to attach or hook the bucket to a cable 22.

According to the method of the present invention, a bore hole unit 2 with the required number of bore hole units 1 are driven into the ground from which it is desired to extract petroleum, for instance down to as much as several thousand feet. Steam at the desired pressure is then fed to the surrounding underground through the pipes 7 and the outlet elements 9 and 10 and, possibly also, through additional pipes 13. The petroleum thus made, more fluid by the heat of the steam flows by gravity to the central passage 20 through the slots or apertures 5.

The petroleum may thus be simultaneously be pumped out of the central passage 20 by repeated up-and-down displacement of the bucket 14 in this passage. There results repeated filling and emptying of the bucket at the bottom and top respectively of the bore hole.

What I claim is:

1. In an arrangement for the extraction of bituminous products from underground tar sand deposits, the combination of a string of bore hole units detachably connected in end-to-end relationship and extending through an underground tar sand deposit, said string including a lowermost bore hole unit and several upper bore hole units, each unit including a pair of coaxially arranged inner and outer tube sections defining an annular space between each other, each tube section having vertical slots for the radially inward passage of liquefied bituminous products through both sections into the inner tube section, coupling means at both ends of each upper bore hole unit and at the upper end of the lowermost bore hole unit for interconnecting all of said units as a string, the outer tube section of the lowermost bore hole unit having a pointed and closed lower end, and the inner tube section of the lowermost bore hole unit being closed by a closure plate, each unit carrying a plurality of steam pipe sections positioned in said annular space, extending lengthwise and substantially co-extensive with said tube sections in laterally spaced-apart relation around the circumference of said annular space, detachable coupling means at each end of the steam pipe sections of said upper bore units and at the upper end of the steam pipe sections of the lowermost bore hole unit for interconnecting said pipe sections as continuous pipes, said pipes extending to an above ground location to be connected to a supply of steam under pressure, each pipe section having at least one outlet which is radially outwardly directed relative to the bore hole units, so as to inject steam into the surrounding tar sand desposit all around and along the length of the string to lower the viscosity of the bituminous products and cause its radially inward flow into the inner tube sections of said string, and means to elevate the bituminous products relative to the inner tube sections to an accessible above ground location.

2. In an arrangement as claimed in claim 1, wherein said means include a bucket located within said inner tube sections and longitudinally displaceable therein, said bucket having a bottom forming a check valve constructed to allow entry of the bituminous products upon immersion of the bucket in the latter in the lower portion of said string of bore hole units.

3. A method of extracting highly viscous petroleum from an underground bituminous deposit, comprising inserting a string of detachably interconnected bore hole units into the ground, each unit including a pair of coaxially arranged tube sections defining an intermediate annular space and having lateral apertures therethrough, feeding pressurized steam along said annular space and outwardly from the lower end of each unit to heat the bituminous deposit and decrease its viscosity, allowing the liquefied petroleum to flow inwardly through said tube sections into the inner tube sections and pumping out the petroleum from said inner tube sections simultaneously with the feeding of steam.

4. A method as claimed in claim 3, wherein said pumping includes repetitively displacing a bucket up and down the inner tube sections of said string, filling of said bucket at the bottom portion of said string and emptying the same at an above ground location.

* * * * *